US005558440A

United States Patent [19]

Miller

[11] Patent Number: 5,558,440

[45] Date of Patent: Sep. 24, 1996

[54] ARTICLE FOR RETAINING OBJECTS

[76] Inventor: E. Lynn Miller, 1002 Locust St., Columbia, Mo. 65205

[21] Appl. No.: 167,843

[22] PCT Filed: Jun. 13, 1991

[86] PCT No.: PCT/US91/04157

§ 371 Date: Dec. 13, 1993

§ 102(e) Date: Dec. 13, 1993

[87] PCT Pub. No.: WO92/22463

PCT Pub. Date: Dec. 23, 1992

[51] Int. Cl.[6] ..... B65D 30/20

[52] U.S. Cl. ..... 383/87; 383/2; 383/66; 383/120

[58] Field of Search ..... 383/8, 66, 87, 383/120, 2, 38

[56] References Cited

U.S. PATENT DOCUMENTS

| | | | |
|---|---|---|---|
| 1,282,878 | 10/1918 | Lagois . | |
| 1,629,404 | 5/1927 | Mitchell . | |
| 1,871,549 | 8/1932 | Miller | 383/38 X |
| 2,215,689 | 9/1940 | Dickson | 383/66 X |
| 2,474,495 | 6/1949 | Pollack . | |
| 2,683,262 | 7/1954 | Foss | 383/66 X |
| 2,921,731 | 1/1960 | Voleckening et al. . | |
| 2,953,137 | 9/1960 | Simril . | |
| 3,009,614 | 11/1961 | Humphner . | |
| 3,510,052 | 5/1970 | Ruda . | |
| 3,680,751 | 8/1972 | Ten Brook . | |
| 3,771,717 | 11/1973 | McDermott et al. . | |
| 3,834,528 | 9/1974 | Pickford et al. | 383/120 X |
| 3,977,452 | 8/1976 | Wright . | |
| 3,987,959 | 10/1976 | Deards et al. | 383/120 X |
| 4,441,639 | 4/1984 | Craw et al. . | |
| 4,461,030 | 7/1984 | Knudsen . | |
| 4,523,703 | 6/1985 | McKenna . | |
| 4,720,872 | 1/1988 | Kaczerwaski | 383/120 X |
| 4,753,316 | 4/1988 | Fröidh et al. | 383/120 X |
| 4,896,465 | 1/1990 | Rhodes et al. . | |
| 4,988,653 | 3/1991 | LaBelle . | |
| 5,341,928 | 8/1994 | Jones et al. | 383/120 X |

FOREIGN PATENT DOCUMENTS

| | | | |
|---|---|---|---|
| 2469355 | 5/1981 | France | 383/8 |
| 9101401 | 2/1991 | WIPO | 383/120 |

*Primary Examiner*—Jes F. Pascua

*Attorney, Agent, or Firm*—Kokjer, Kircher, Bowman & Johnson

[57] ABSTRACT

An expandable pouch (10) that can be easily compacted to form a relatively thin flat relatively non-obtrusive strip when empty. The compacted pouch will remain compact without falling open even with relatively vigorous activity and movement. The pouch (10) may be provided with a strap (30) for attaching the pouch to a user's wrist or waist.

13 Claims, 2 Drawing Sheets

ARTICLE FOR RETAINING OBJECTS

This invention relates in general to an article useful for retaining objects, and more particularly relates to an expandable pouch that can be strapped or otherwise releasably fastened to a person's body for retaining objects.

Active people frequently need to carry personal objects with them while participating in physical activities. For example, joggers and bicyclist need to carry items such as money, a door key, or perhaps a snack with them while jogging or riding. Children also frequently require a container for storing personal objects during playtime.

Many children wear dental retainers that should not be worn while playing contact sports for example. Oftentimes these objects are either too large, bulky or breakable to store safely in a pocket. In addition, smaller objects such as keys or coins tend to fall out of pockets during vigorous activities. Purses, sacks or satchels are relatively bulky and burdensome to carry and they limit free movement substantially. There is also a substantial risk that a purse or satchel will be stolen if it is set aside to participate in activities. Therefore, it is desirable to have a closable container that can be easily carried by a person without limiting his or her freedom of movement.

It is known to provide a container such as a small closable sack or pouch for holding objects that can be strapped or otherwise releasably attached to a person's body. In the past, these containers have been provided as cloth sacks attached to a strap for fastening around the waist or wrist of a person. Although these sacks permit relatively free movement as compared with a purse or other similar satchel, they are relatively conspicuous and bulky even when empty.

It is therefore an object of the present invention to provide an article for retaining objects that can be strapped or otherwise releasably attached to the body.

It is a further object to provide such an article which is easily compacted when empty to a flat configuration article that is non-obtrusive and nonconspicuous.

These and other objects are achieved by an expandable pouch that can be easily compacted to form a relatively thin flat relatively non-obtrusive strip when empty. The compacted pouch will remain compact without falling open even with relatively vigorous activity and movement.

The objects and features of the invention noted above are explained in more detail with reference to the drawings in which like reference numerals denote like elements, and in which.

Figure 1:
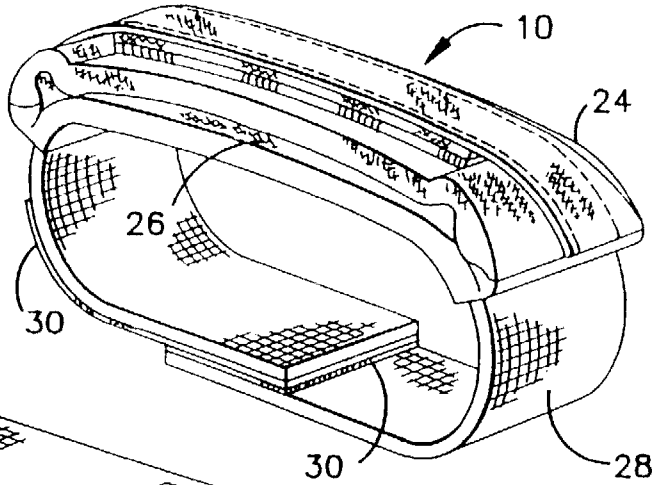
FIG. 1 is a perspective view of a pouch according to the present invention in a compact configuration attached to a circular band.
Figure 2:
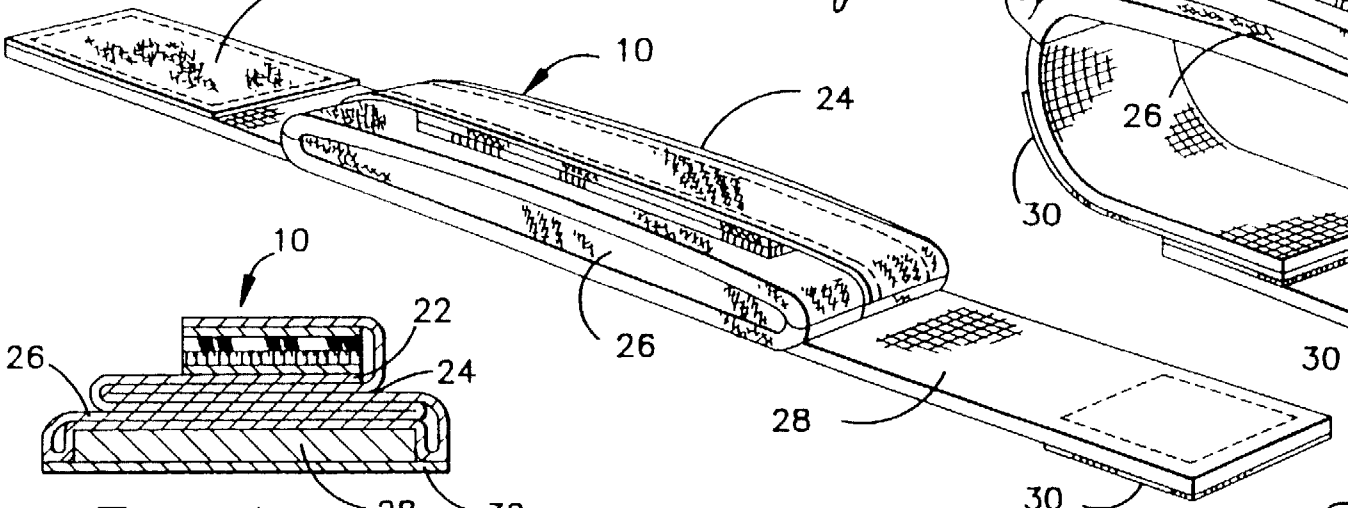
FIG. 2 is a perspective view of the pouch of FIG. 1 affixed to a band that is lying flat.
Figure 3:
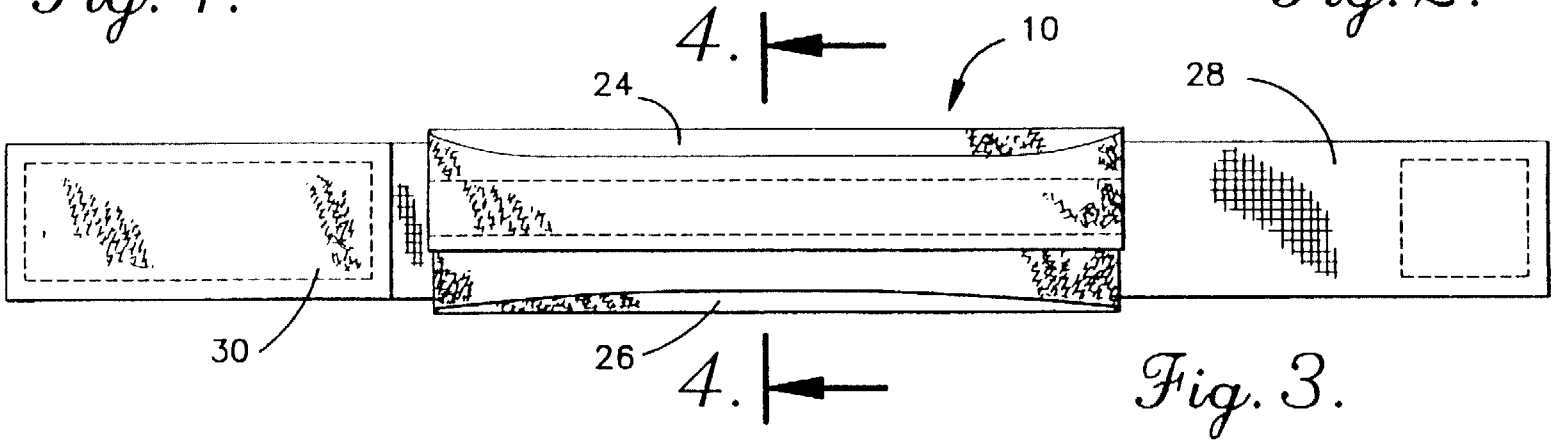
FIG. 3 is a top plan view of the pouch of FIG. 2.

Referring now to the drawings in more detail, numeral 10 generally designates a pouch made in accordance with the present invention. Looking to FIG. 6, the pouch 10 is made from a piece of fabric or similarly flexible material, wherein the fabric is folded over at both ends toward the center so that the opposing ends 20, 22 of the fabric overlap slightly at the center of the fabric piece thus forming a tubular shape.

Figure 5:
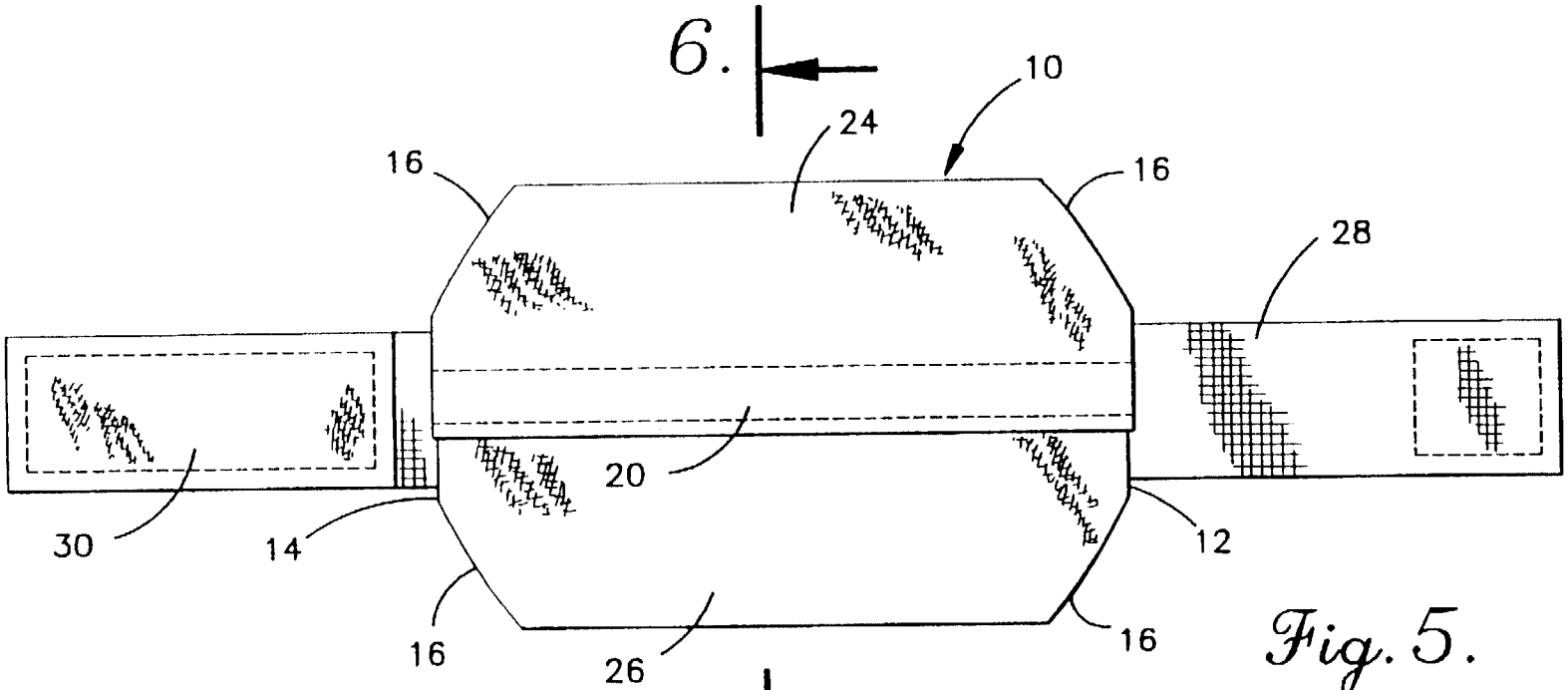
FIG. 5 is a top plan view of a pouch according to the present invention in a fully expanded configuration.

Since the fabric is preferably somewhat flexible, this tubular shape may be collapsed to form a top layer and a bottom layer of cloth connected along the lateral edges by folds. As is best shown in FIG. 5, the top and bottom layers of fabric are permanently affixed to one another, preferably by stitching, along the longitudinal end edges 12, 14 of the fabric layers. It is noted that the overlap of the opposing ends 20,22 is maintained due to this fixing of the edges 12, 14. It is preferred that the corners of the longitudinal ends are removed prior to fixing to form angled portions 16 adjacent the lateral edges. The angled portions are preferably about a 45° angle, and arranged to be spaced from each other along the longitudinal ends by a distance at least equal to the overlap of the opposed ends 20,22.

Figure 6:
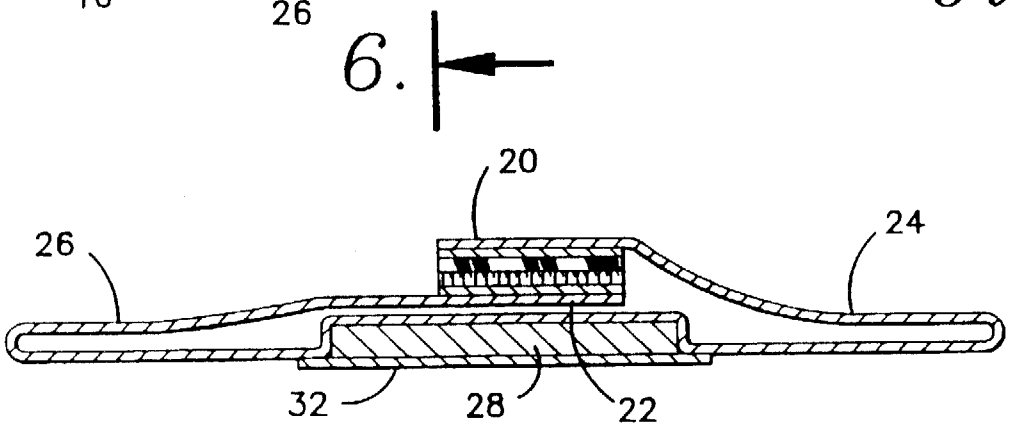
FIG. 6 is a cross-sectional view taken along line 6—6 of FIG. 5.

As is best shown in FIG. 6, the pouch thus defines a first concave portion 24 and a second concave portion 26, each having an opening defined by the respective opposed edge 20 or 22 and the portion of the fabric there beneath, and a rear wall portion defined by those portions within the lateral extent of the corner portions 16. The openings of these two portions substantially abut to define a single closed cavity.

As noted above, the opposing ends 20, 22 of fabric overlap at the center of the top fabric layer of the pouch to define a slit or opening for access to the cavity. Corresponding fasteners such as that sold under the tradename VELCRO, are affixed to the underside of the overlapping end 20 and the upperside of the underlying end 22 to provide a means for securing the two ends of the fabric for temporary closure of the pouch. Other fastening devices such as a slide fastener, snaps or buttons could alternatively be used to releasably secure the two ends 20, 22 together.

Figure 4:
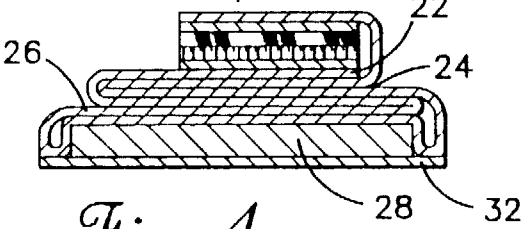
FIG. 4 is a cross-sectional view taken along line 4—4 of FIG. 3.

Looking now to FIGS. 1–4, the pouch can be placed in a compact configuration. To accomplish this, the folded lateral edges of the pouch are moved toward the center of the pouch, reversely folded in the process, and placed in a spaced overlapping position. As such, in this configuration the lateral sides of the pouch substantially corresponding to the rear wall portions of the first concave portion 24 and second concave portion 26 are inversely folded toward the center of the pouch in a convex configuration. This convex folding is aided by the removal of corner material to form the corner portions 16. The convex rear wall segment of the first portion 24 overlies the convex rear wall segment 26 of the second portion. As best shown in FIG. 4, the pouch takes on an accordion fold configuration when compacted in this manner. The compacted pouch is relatively thin and flat, thus providing a non-obtrusive article when empty.

The pouch can be detachably affixed to a band 28 adapted to retain the pouch to the user's body or to some other structure. Band 28 is elongated with the longitudinal ends having a fastening device 30, preferably that sold under the tradename VELCRO, for releasably connecting such ends together. Thus, as shown in FIG. 1, the band can be secured in a circular configuration to fit around a person's wrist, waist or ankle for example.

As shown in FIG. 6 the pouch 10 can be attached to the band by providing a tunnel loop 32 along the bottom center of the pouch, beneath the opposed ends 20,22. This loop 32 preferably comprises a separate strip of fabric or similarly flexible material affixed along the bottom center portion of the pouch to form a loop through which the band 28 is threaded. The pouch could be affixed to the band by any other method known such as by fastening the pouch to the band with snaps, buttons, or materials such as that sold under the tradename VELCRO. Alternatively, the pouch can be permanently affixed to a band by stitching or other means. The pouch could be provided on any type of band or strap such as a wrist, ankle or waist band for releasably securing the pouch to the body. The pouch could also be affixed to an article of clothing such as to a belt loop by tying the pouch to the loop, by snap loops provided on the bottom of the pouch or through the use of fasteners such as that sold under the tradename VELCRO.

The pouch can be made from any flexible material and is preferably made of a tightly woven fabric-like material. Preferably the fabric will be lightweight, relatively waterproof and sturdy. Particularly suitable materials include lightweight and quick drying fabrics such as those sold under the tradenames NYLON and TASLYN.

While the present invention has been described with regard to a specific embodiment, it should be apparent that various modifications may be made without departing from the spirit of the invention. For example, the pouch need not be formed of a single pieces of fabric, but may be formed of two or more pieces fixed together to provide the proper configuration. Additionally, the means for attaching the pouch to the user's body or other structure may be any type commonly known in the art.

From the foregoing it will be seen that this invention is one well adapted to attain all ends and objects herein above set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The embodiments of the invention in which an exclusive property or privilege is claimed are defined as follows:

1. A pouch which may be secured to the body of a user, said pouch comprising a top layer and a bottom layer of fabric which together form a closed cavity for retaining articles, said top and bottom layers each having a center section extending parallel to and between side sections, the side sections being releasably folded inward of the closed cavity into overlapping relationship with one another and between the center sections of the top and bottom layers, the center section of the top layer including an access opening into said closed cavity and the center section of the bottom layer including a means for releasably attaching said pouch to the body of the user.

2. A pouch in accordance with claim 1, wherein said pouch additionally comprises a means for releasably closing said access opening.

3. A pouch in accordance with claim 2, wherein said pouch additionally comprises a strap affixed to said bottom layer of fabric for mounting said pouch on the user's body part.

4. A pouch in accordance with claim 2, wherein said means for releasably closing said access opening comprises corresponding fasteners selected from the group consisting of hook and loop fasteners, slide fasteners, snaps, buttons and combinations thereof.

5. A pouch in accordance with claim 1, wherein said fabric is a water resistant fabric.

6. A pouch which may be affixed to the body of a user for retaining objects, said pouch being made from a sheet of fabric having lateral side edges and longitudinal end edges wherein the side edges are folded toward one another into an overlapping configuration so as to form top and bottom layers of fabric and the end edges of the top and bottom layers are affixed together so as to provide a closed cavity having an access opening formed by the overlapped side edges, the top and bottom layers each having a center section extending parallel the overlapped side edges and having first and second outer sections on opposite sides of the center section wherein the first and second outer sections are releasably folded inward of the closed cavity into overlapping relationship with one another between the center section of the top and bottom layers.

7. A pouch according to claim 6, wherein the overlapping portions of said lateral side edges are affixed one above the other along the longitudinal end edges of the overlapping portions.

8. A pouch according to claim 7, wherein the overlapping portions of said lateral side edges are releasably affixed one above the other along the lateral side edges.

9. A pouch in accordance with claim 8, wherein said overlapping portions of said lateral side edges are releasably affixed to one another by corresponding fasteners selected from the group consisting of hook and loop fasteners, slide fasteners, snaps, buttons, and combinations thereof.

10. A pouch according to claim 6, wherein said pouch additionally comprises a strap affixed to said pouch along the bottom layer of said sheet of fabric.

11. A pouch in accordance with claim 6, wherein said top and bottom layers of fabric are affixed together by stitching the top and bottom layers together along overlapping portions of the longitudinal end edges.

12. A pouch in accordance with claim 6, wherein first and second outer sections have angled corners.

13. A pouch in accordance with claim 6, wherein said overlapping portions of said lateral side edges extend within the center section.

* * * * *